US010281837B1

(12) United States Patent
Hayashi et al.

(10) Patent No.: US 10,281,837 B1
(45) Date of Patent: May 7, 2019

(54) DEVELOPING DEVICE AND IMAGE FORMING APPARATUS THEREWITH

(71) Applicant: KYOCERA Document Solutions Inc., Osaka (JP)

(72) Inventors: Masaki Hayashi, Osaka (JP); Eiji Nimura, Osaka (JP); Koji Kuramashi, Osaka (JP)

(73) Assignee: KYOCER Documents Solutions Inc., Osaka (JP)

( * ) Notice: Subject to any disclaimer, the term of this patent is extended or adjusted under 35 U.S.C. 154(b) by 0 days.

(21) Appl. No.: 16/138,425

(22) Filed: Sep. 21, 2018

(30) Foreign Application Priority Data

Nov. 13, 2017 (JP) ..... 2017-217975

(51) Int. Cl.
*G03G 15/09* (2006.01)
*G03G 15/08* (2006.01)

(52) U.S. Cl.
CPC ..... *G03G 15/081* (2013.01); *G03G 15/0921* (2013.01)

(58) Field of Classification Search
CPC ..... G03G 15/081
See application file for complete search history.

(56) References Cited

U.S. PATENT DOCUMENTS

2008/0181676 A1* 7/2008 Yamagishi ..... G03G 15/0812 399/275

FOREIGN PATENT DOCUMENTS

JP 2003-255710 A 9/2003

* cited by examiner

*Primary Examiner* — Clayton E. LaBalle
*Assistant Examiner* — Jas A Sanghera
(74) *Attorney, Agent, or Firm* — Stein IP, LLC

(57) ABSTRACT

A developing device has a developer carrier, a regulating member, a regulating pole, and a magnetic pole generation member. The regulating member has a magnetic body for regulating the thickness of developer on the surface of the developer carrier. The regulating pole is arranged inside the developer carrier to face the regulating member. The magnetic pole generation member is arranged upstream of the regulating member in the developer carrier rotation direction, and has a magnet for generating, at an end portion of the regulating member, a magnetic pole of a polarity different from that of the regulating pole. The regulating member has, in its side face, a depressed portion having an inner face with an arc-shaped cross-section. The magnetic pole generation member is cylindrical, with a radius substantially equal to that of the inner face of the depressed portion, and is rotatable while staying fitted in the depressed portion.

8 Claims, 6 Drawing Sheets

DEVELOPING DEVICE AND IMAGE FORMING APPARATUS THEREWITH

INCORPORATION BY REFERENCE

This application is based upon and claims the benefit of priority from the corresponding Japanese Patent Application No. 2017-217975 filed on Nov. 13, 2017, the contents of which are hereby incorporated by reference.

BACKGROUND

The present disclosure relates to a developing device, and to an image forming apparatus incorporating a developing device. More particularly, the present disclosure relates to a developing device including a regulating member for regulating the thickness of developer on the surface of a developer carrier, and to an image forming apparatus incorporating such a developing device.

A conventionally common developing method adopted in image forming apparatuses using an electrophotographic process typically uses powdery developer and involves a process including visualizing an electrostatic latent image formed on a developer carrier such as a photosensitive drum with the developer, then transferring the visualized image (toner image) to a recording medium, and then fixing the image.

Developer is broadly classified into two-component developer comprising toner and magnetic carrier and one-component developer comprising non-magnetic or magnetic toner alone. For example, a developing device using a magnetic one-component developing method stores magnetic toner (hereinafter, simply referred to as toner), and feeds the toner from a stirring member to a developing roller (developer carrier). The developing roller is provided with a magnet (regulating pole or the like) inside, and carries toner on the surface of the developing roller with the magnet (regulating pole or the like). By the rotation of the developing roller, the toner is conveyed to a part opposite a photosensitive member. The toner carried on the developing roller is then fed to the photosensitive member, and an electrostatic latent image on the photosensitive member is visualized as a toner image.

There are known developing devices which are provided with a regulating member comprising a magnetic body for regulating the thickness of toner so that the amount of toner conveyed to a part opposite the photosensitive member by the rotation of the developing roller is constant, and a magnet arranged on the upstream side of the regulating member in the developing roller rotation direction. In these developing devices, by arranging a magnet on the upstream side of the regulating member in the developing roller rotation direction, a magnetic pole with a polarity different from that of a regulating pole is induced at a tip end portion (end part on the developing roller side) of the regulating member, and toner that passes between the developing roller and the regulating member is regulated into a predetermined thickness.

SUMMARY

According to one aspect of the present disclosure, a developing device is provided with a developer container, a developer carrier, a regulating member, a regulating pole, and a magnetic pole generation member. The developer container stores magnetic developer. The developer carrier is rotatably supported on the developer container, and carries the developer on its outer circumferential face. The regulating member is arranged opposite the developer carrier at a predetermined interval, and comprises a magnetic body for regulating the thickness of developer on the surface of the developer carrier. The regulating pole is arranged inside the developer carrier so as to face the regulating member. The magnetic pole generation member is arranged on the upstream side of the regulating member in the developer carrier rotation direction, and has a magnet for generating, at an end portion of the regulating member, a magnetic pole of a polarity different from that of the regulating pole. In a side face of the regulating member on the upstream side in the developer carrier rotation direction, a depressed portion having an inner face with an arc-shaped cross-section is provided. The magnetic pole generation member is formed in a cylindrical shape with a radius substantially equal to that of the inner face of the depressed portion, and is rotatable while staying fitted in the depressed portion.

This and other objects of the present disclosure, and the specific benefits obtained according to the present disclosure, will become apparent from the description of embodiments which follows.

DETAILED DESCRIPTION

Embodiments of the present disclosure will be described below with reference to the accompanying drawings.

A First Embodiment

Figure 1:
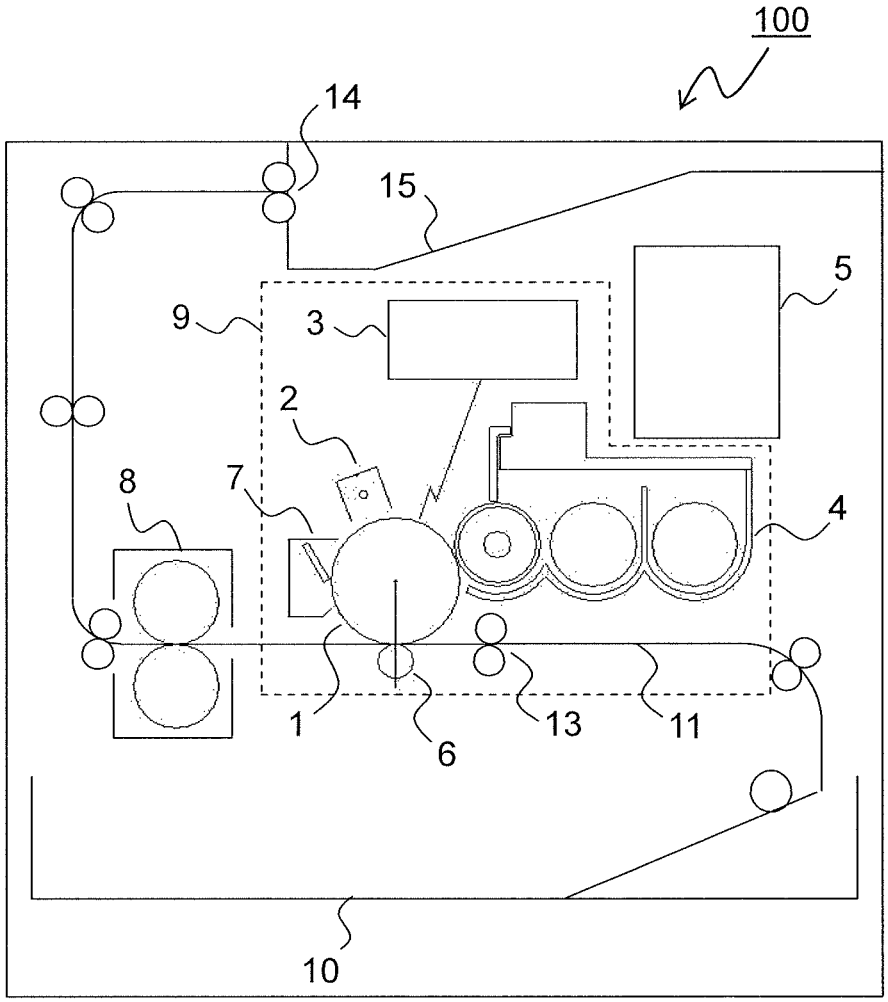
FIG. 1 is a schematic cross-sectional view of an image forming apparatus provided with a developing device according to a first embodiment of the present disclosure.

FIG. 1 is a schematic cross-sectional view of an image forming apparatus 100 provided with a developing device 4 according to a first embodiment of the present disclosure. When the image forming apparatus (here, a monochrome printer) 100 performs an image forming operation, in an image forming portion 9 inside an apparatus main body, an electrostatic latent image is formed on the surface of a photosensitive drum 1 based on image data transmitted from, for example, an unillustrated personal computer, and the developing device 4 attaches toner to the electrostatic latent image to form a toner image. The toner is fed to the developing device 4 from a toner container 5. The image forming apparatus 100, while rotating the photosensitive drum 1 in a clockwise direction in FIG. 1, executes an image forming process with respect to the photosensitive drum 1.

In the image forming portion 9, there are provided, along the rotation direction of the photosensitive drum 1 (in the clockwise direction), a charging device 2, an exposure unit 3, the developing device 4, a transfer roller 6, a cleaning device 7, and a static eliminator (unillustrated). The photosensitive drum 1 is, for example, an aluminum drum coated with a photosensitive layer, and its surface can be electrostatically charged uniformly by the charging device 2. The exposure unit 3 irradiates the surface of the photosensitive drum 1 with a light beam (for example, a laser beam) based on image data, and thereby forms an electrostatic latent image on the surface of the photosensitive drum 1.

The developing device 4 serves to form a toner image by attaching toner to the electrostatic latent image on the photosensitive drum 1. In this embodiment, magnetic one-component developer (hereinafter also referred to as developer or toner) comprising magnetic toner is stored in the developing device 4. The details of the developing device 4 will be described later. The cleaning device 7 is provided with a cleaning roller, cleaning blade, or the like that makes line contact with the photosensitive drum 1 in its longitudinal direction (the direction perpendicular to the plane of FIG. 1), and after the toner image is transferred to a sheet, the cleaning device 7 removes the toner (unused toner) that remains on the surface of the photosensitive drum 1.

Toward the photosensitive drum 1, where the toner image has now been formed as described above, a sheet is conveyed with predetermined timing from a sheet storage portion 10 through a sheet conveying passage 11 via a registration roller pair 13. The transfer roller 6 transfers, without disturbing, the toner image formed on the surface of the photosensitive drum 1 to a sheet conveyed through the sheet conveying passage 11. Then, in preparation for the subsequent formation of a new electrostatic latent image, the cleaning device 7 removes the unused toner on the surface of the photosensitive drum 1, and the static eliminator removes the remaining electric charge.

The sheet having the toner image transferred to it is separated from the photosensitive drum 1, and is conveyed to a fixing device 8, where, under application of heat and pressure, the toner image is fixed to the sheet. The sheet having passed through the fixing device 8 passes between a discharge roller pair 14, and is discharged onto a sheet discharge portion 15.

Figure 2:
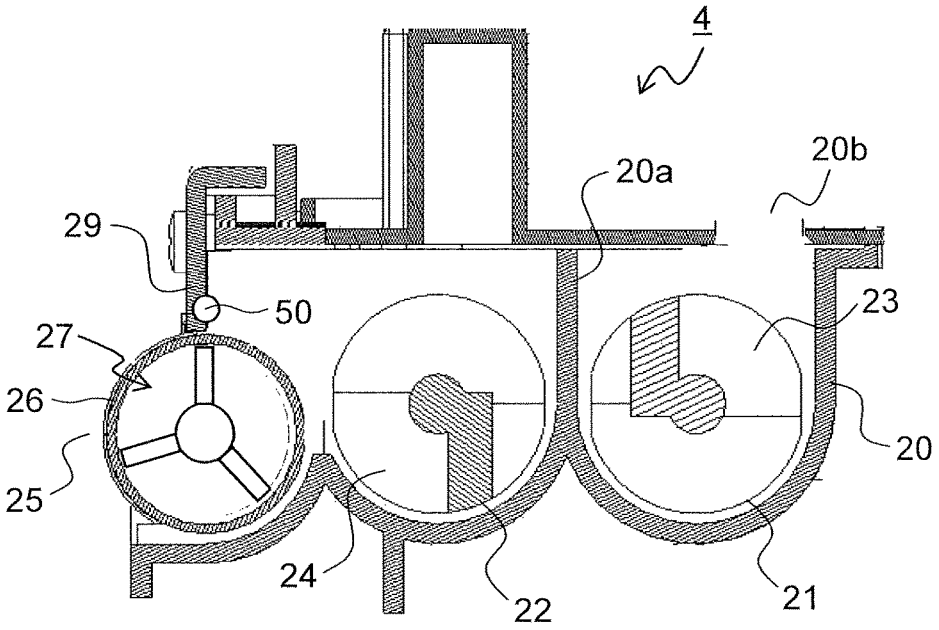
FIG. 2 is a side cross-sectional view of the developing device according to the first embodiment of the present disclosure.

FIG. 2 is a side cross-sectional view of the developing device 4. As shown in FIG. 2, the developing device 4 is provided with a resin housing 20 (developer container) in which developer is stored. The inside of the housing 20 is partitioned into a first storage chamber 21 and a second storage chamber 22 by a partition wall 20*a* which is formed integrally with the housing 20. In the first storage chamber 21, a first stirring screw 23 is arranged, and in the second storage chamber 22, a second stirring screw 24 is arranged.

At the bottom face of the second storage chamber 22 which faces the second stirring screw 24, there is provided a developer amount detection sensor (unillustrated) that detects the amount of developer stored inside the housing 20. Based on the detection result from this developer amount detection sensor, developer stored in the container 5 (see FIG. 1) is fed into the housing 20 via a developer feeding port 20*b* provided in an upper part of the housing 20.

The first stirring screw 23 and the second stirring screw 24 are each configured to have a helical blade around a supporting shaft (rotary shaft), and they are rotatably supported on the housing 20 parallel to each other. There is no partition wall 20*a* in opposite end parts of the housing 20 in its longitudinal direction, that is, the axial direction of the first stirring screw 23 and the second stirring screw 24, and this permits toner to be passed between the first stirring screw 23 and the second stirring screw 24. With this, the first stirring screw 23 conveys the developer inside the first storage chamber 21, while stirring it, to one side in the axial direction (the far side relative to the plane in FIG. 2) and then to the second storage chamber 22. The second stirring screw 24 conveys the developer conveyed to the second storage chamber 22, while stirring it, to the other side in the axial direction (the near side relative to the plane of FIG. 2) and feeds it to a developing roller (developer carrier) 25.

The developing roller 25 is rotatably pivoted on the housing 20 parallel to the first stirring screw 23 and the second stirring screw 24. The first stirring screw 23, the second stirring screw 24, and the developing roller 25 are driven to rotate by a motor (unillustrated).

Figure 3:
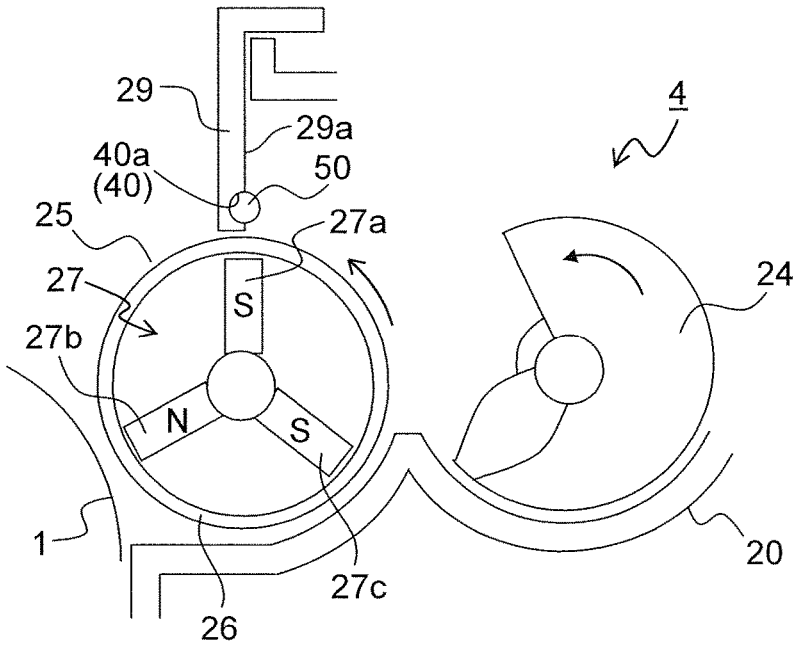
FIG. 3 is a cross-sectional view of the structure of and around a regulating pole and a regulating blade in the developing device according to the first embodiment of the present disclosure.

By rotating according to the rotation of the photosensitive drum 1 (see FIG. 1), the developing roller 25 feeds developer to the photosensitive layer on the photosensitive drum 1. As shown in FIG. 3, the developing roller 25 includes a cylindrical non-magnetic developing sleeve 26 that rotates in the counter-clockwise direction in the diagram, and a fixed magnet body 27 comprising a permanent magnet which is fixed inside the developing sleeve 26 and which has a plurality of magnetic poles. With the magnetic force of this fixed magnet body 27, developer is attached to (carried on) the outer circumferential face of the developing roller 25 and a magnetic brush is formed. In this embodiment, the fixed magnet body 27 has three magnetic poles, namely, a regulating pole 27*a* which is an S pole, a main pole 27*b* which is an N pole, and a separating pole 27*c* which is an S pole. The regulating pole 27*a* is arranged opposite a regulating blade (regulating member) 29, which will be described later.

The regulating blade (regulating member) 29 which regulates the thickness of developer carried on the developing roller 25 is fitted to the housing 20 along the developing roller 25 in its longitudinal direction (direction perpendicular to the plane of FIG. 3). The regulating blade 29 is arranged on the upstream side of the position where the developing roller 25 and the photosensitive drum 1 face each other in the rotation direction of the developing roller 25 (in the counter-clockwise direction in the diagram). A small gap is formed between a tip end portion of the regulating blade 29 and the surface of the developing roller 25.

The regulating blade 29 comprises a magnetic body (e.g., SUS430), and is formed with a predetermined thickness. The regulating blade 29 is fixed to an upper part of the housing 20.

At the tip end portion of the regulating blade 29 (part on the developing roller 25 side), on the upstream side in the rotation direction of the developing roller 25, a magnetic pole generation member 50 is arranged.

Figure 4:
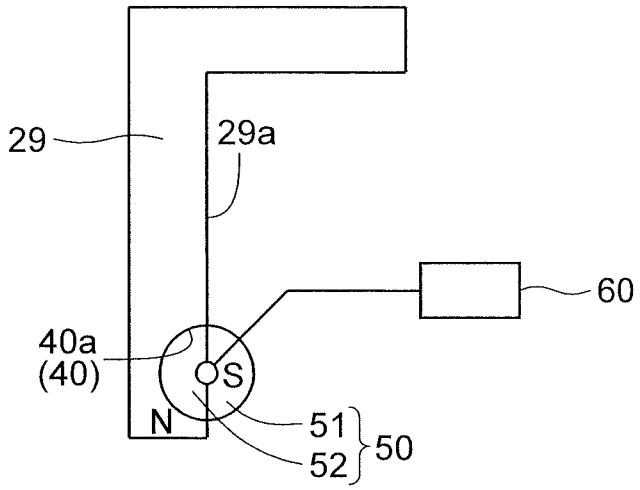
FIG. 4 is a side view of the structure of the regulating blade and a magnetic pole generation member in the developing device according to the first embodiment of the present disclosure.

As shown in FIG. 4, the magnetic pole generation member 50 includes a magnet 51 which has an S pole, and this induces an N pole (magnetic pole) at the tip end portion (a developing roller 25-side end part) of the regulating blade 29. With this, a magnetic field is generated between a tip end of the regulating blade 29 and the developing sleeve 26, and the developer on the surface of the developing roller 25 is, when it passes between the regulating blade 29 and the developing roller 25, regulated into a predetermined thickness.

Figure 5:
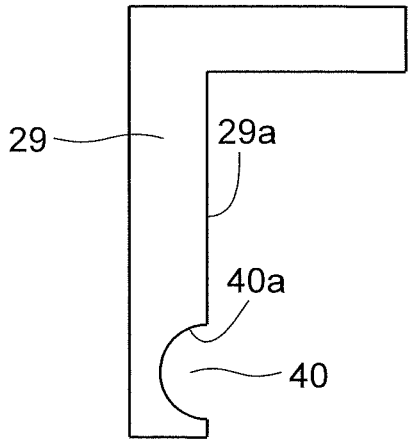
FIG. 5 is a side view of the structure of the regulating blade in the developing device according to the first embodiment of the present disclosure.

In this embodiment, as shown in FIG. 5, a depressed portion 40 which has an inner face 40*a* with an arc-shaped cross-section is provided in a side face 29*a* of the regulating blade 29 on the upstream side in the rotation direction of the developing roller 25. The depressed portion 40 is formed in a semicircular shape as seen in a cross-sectional view.

As shown in FIG. 4, the magnetic pole generation member 50 is formed in a cylindrical shape with a radius substantially equal to (or slightly smaller than) that of the inner face 40*a* of the depressed portion 40, and is fitted in the depressed portion 40. The magnetic pole generation member 50 is formed to extend in the axial direction (direction perpendicular to the plane of FIG. 4) of the developing roller 25. One end of the magnetic pole generation member 50 is connected to a driving motor 60 via a gear train or the like. The magnetic pole generation member 50 is rotatable while staying fitted in the depressed portion 40.

The magnetic pole generation member 50 is formed as a result of the magnet 51 and a magnetic member 52 being arranged next to each other along the circumferential direction of the magnetic pole generation member 50. In this embodiment, along the circumferential direction, one half of the magnetic pole generation member 50 is formed by the magnet 51, and the other half is formed by the magnetic member 52. As shown in FIG. 4, during image formation (during thickness regulation), the magnetic member 52 is arranged inside the depressed portion 40, and the magnet 51 is arranged outside the depressed portion 40.

Figure 6:
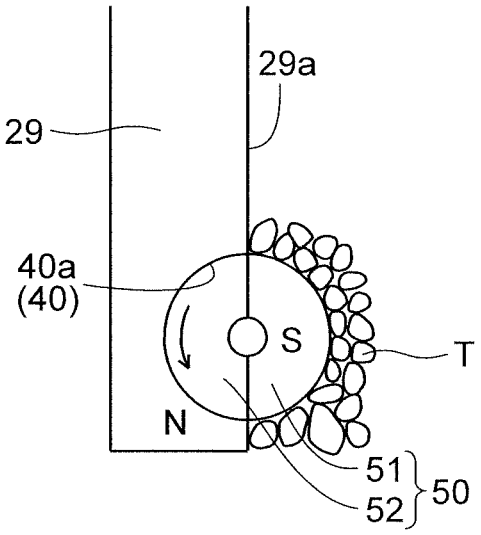
FIG. 6 is an enlarged view of the structure of and around the magnetic pole generation member in the developing device according to the first embodiment of the present disclosure, showing a state where toner clusters are attached around the magnetic pole generation member.
Figure 7:
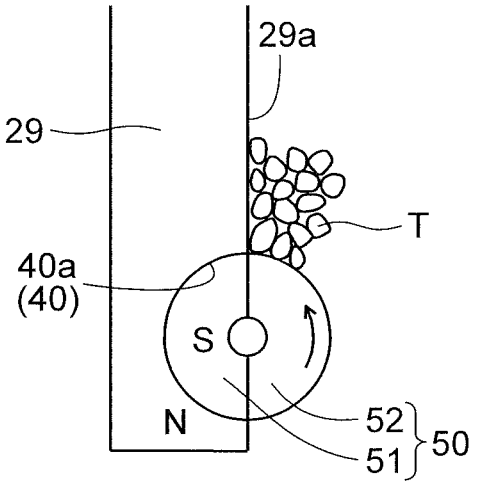
FIG. 7 is a diagram showing a state where the magnetic pole generation member is rotated by half a turn from the state in FIG. 6.
Figure 8:
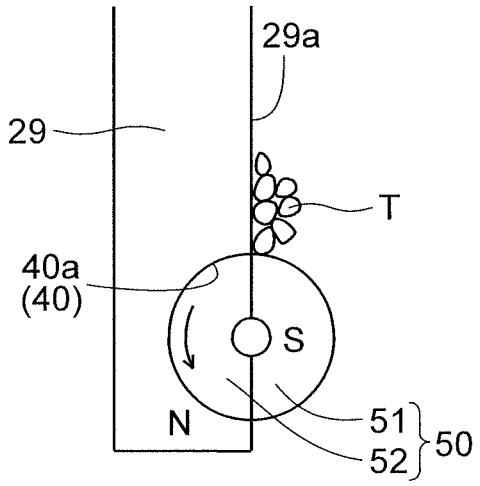
FIG. 8 is a diagram showing a state where the magnetic pole generation member is further rotated by half a turn from the state in FIG. 7.

In this image forming apparatus 100, as image forming operation (thickness regulation) is repeatedly performed, as shown in FIG. 6, toner attaches cumulatively around the magnetic pole generation member 50, and forms toner clusters T. Here, by rotating the magnetic pole generation member 50 in such a direction (in the counter-clockwise direction in FIG. 6) that a part arranged outside the depressed portion 40 (the magnet 51 in FIG. 6) moves away from the developing roller 25, as shown in FIGS. 7 and 8, the toner clusters T attached to the outer circumferential face of the magnetic pole generation member 50 is scraped off at the side face 29*a* of the regulating blade 29. This eliminates or reduces the toner clusters T around the magnetic pole generation member 50. In this embodiment, the magnetic pole generation member 50 is rotated in the counter-clockwise direction in FIG. 8, and thus hardly any toner clusters T are left between the magnetic pole generation member 50 and the developing roller 25. This toner cluster T eliminating operation achieved by rotating the magnetic pole generation member 50 is preferably performed during a non-image formation period.

In this embodiment, as described above, the depressed portion 40 which has the inner face 40*a* with an arc-shaped cross-section is provided in the side face 29*a* of the regulating blade 29. The magnetic pole generation member 50 is formed in a cylindrical shape with a radius substantially equal to that of the inner face 40*a* of the depressed portion 40, and is rotatable while staying fitted in the depressed portion 40. With the rotation of the magnetic pole generation member 50, the toner clusters T attached to the outer circumferential face of the magnetic pole generation member 50 are scraped off at the side face 29*a* of the regulating blade 29. The toner clusters T around the magnetic pole generation member 50 can be thus eliminated or reduced. This suppresses the occurrence of image defects due to toner clusters T.

By providing the depressed portion 40 such that it has the inner face 40*a* with an arc-shaped cross-section, and by fitting the magnetic pole generation member 50 formed in a cylindrical shape with a radius substantially equal to that of the inner face 40*a* into the depressed portion 40, unlike in a case where the depressed portion 40 is formed, for example, in a rectangular shape, it is possible to prevent a space from being formed between the inner face 40*a* of the depressed portion 40 and the magnetic pole generation member 50. This suppresses degradation of the magnetic force of the magnetic pole (N pole) induced at the tip end portion of the regulating blade 29.

As mentioned above, the magnetic pole generation member 50 is formed as a result of the magnet 51 and the magnetic member 52 being arranged next to each other along the circumferential direction. By providing the magnetic member 52 on the magnetic pole generation member 50, it is possible to easily induce (generate) the magnetic pole (N pole) at the tip end portion of the regulating blade 29.

As mentioned above, during an image formation, the magnetic member 52 is arranged inside the depressed portion 40, and the magnet 51 is arranged outside the depressed portion 40. In this way, unlike in a case where the magnetic member 52 is arranged outside the depressed portion 40 and the magnet 51 is arranged inside the depressed portion 40, it is possible to increase the volume of the magnetic body that contributes to inducing the magnetic pole (N pole) at the tip end portion of the regulating blade 29. That is, it is possible to make also the magnetic member 52 of the magnetic pole generation member 50 contribute to inducing the N pole at the tip end portion of the regulating blade 29. Thus, compared to a case where the magnetic member 52 is arranged outside the depressed portion 40 and the magnet 51 is arranged inside the depressed portion 40, it is possible to easily increase the magnetic force of the magnet pole (N pole) induced at the tip end portion of the regulating blade 29.

As mentioned above, the magnetic pole generation member 50 rotates in such a direction that a part arranged outside the depressed portion 40 (the magnet 51 in FIG. 6) moves away from the developing roller 25. Thus, as shown in FIG. 8, as the magnetic pole generation member 50 rotates, the toner clusters T between the magnetic pole generation member 50 and the developing roller 25 are eliminated. This effectively suppresses the occurrence of image defects due to toner clusters T.

A Second Embodiment

Figure 9:
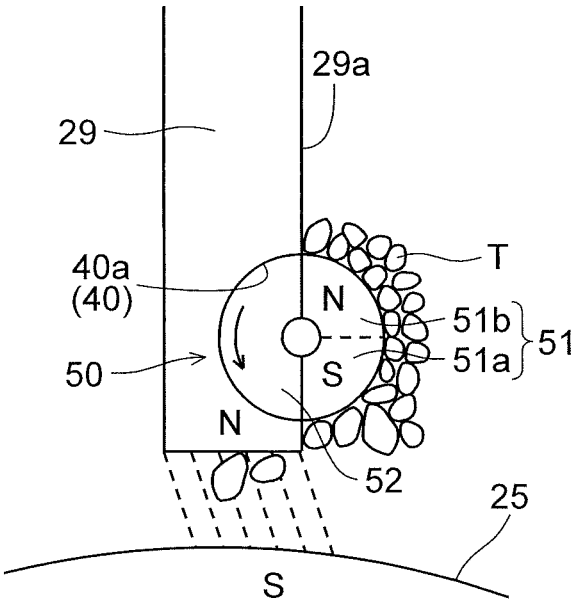
FIG. 9 is an enlarged view of the structure of and around a magnetic pole generation member in a developing device according to a second embodiment of the present disclosure, showing a state where toner clusters are attached around the magnetic pole generation member and at a tip end of a regulating blade.

In a second embodiment of the present disclosure, as shown in FIG. 9, a magnet 51 has a plurality of (here two)

magnetic poles (an S pole 51*a* and an N pole 51*b*) which are arranged next to each other along the circumferential direction of a magnetic pole generation member 50, and which have polarities different from each other. The S pole 51*a* is arranged in a part (lower half) of the magnet 51 on the developing roller 25 side, and the N pole 51*b* is arranged in a part (upper half) of the magnet 51 on the side opposite to a developing roller 25. Thus, as in the first embodiment described above, the N pole is induced at a tip end portion (a developing roller 25-side end part) of a regulating blade 29. A plurality of magnetic poles (the S pole 51*a* and the N pole 51*b*) are each formed to extend in the axial direction (direction perpendicular to the plane of FIG. 9) of the developing roller 25.

Figure 10:
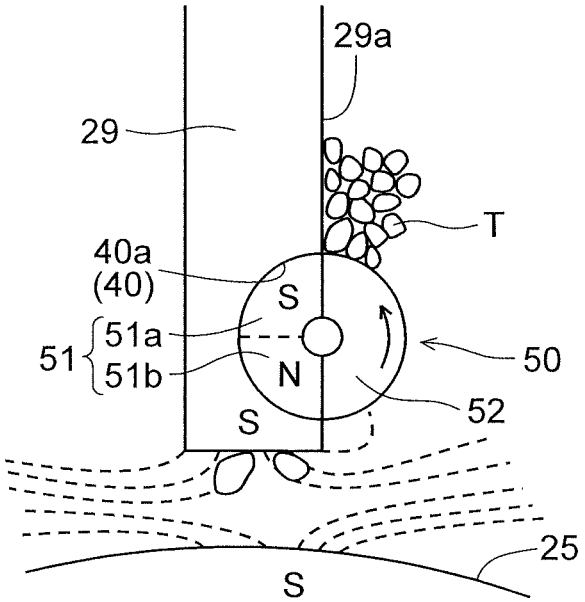
FIG. 10 is a diagram showing a state where the magnetic pole generation member is rotated by half a turn from the state in FIG. 9.
Figure 11:
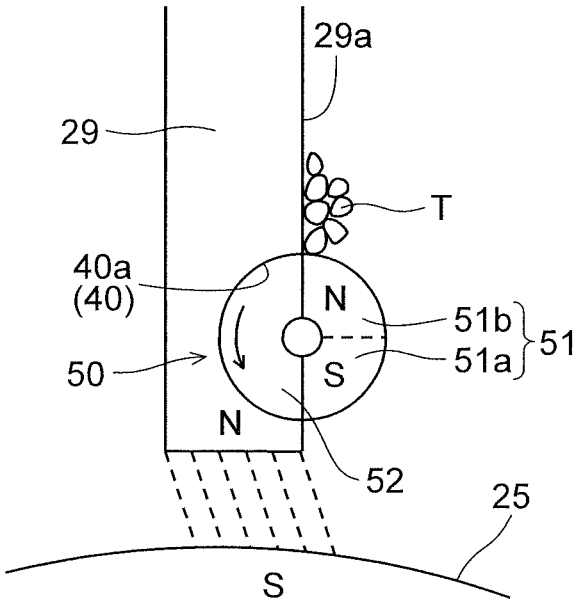
FIG. 11 is a diagram showing a state where the magnetic pole generation member is further rotated by half a turn from the state in FIG. 10.

As in the first embodiment described above, in this image forming apparatus 100, as image forming (thickness regulating) operation is repeatedly performed, toner attaches cumulatively around the magnetic pole generation member 50 as shown in FIG. 9, and forms toner clusters T. By rotating the magnetic pole generation member 50 in the counter-clockwise direction in FIG. 9, as shown in FIGS. 10 and 11, the toner clusters T attached to the outer circumferential face of the magnetic pole generation member 50 are scraped off at a side face 29*a* of the regulating blade 29.

Here, as the magnetic pole generation member 50 rotates, the polarity of a magnetic pole generated at the tip end portion of the regulating blade 29 changes. That is, as shown in FIGS. 9 to 11, the N pole and the S pole are induced alternately at the tip end portion of the regulating blade 29. With this, magnetic lines of force between a tip end of the regulating blade 29 and the developing roller 25 change from a state as shown in FIG. 9 to a state as shown in FIG. 10, and then change from a state as shown in FIG. 10 to a state as shown in FIG. 11. Thus, as shown in FIG. 9, even if the toner clusters T attach to the tip end of the regulating blade 29, the toner clusters T at the tip end of the regulating blade 29 move according to the change in the magnetic lines of force, and as a result, as shown in FIG. 11, the toner clusters T are eliminated from the tip end of the regulating blade 29 or are reduced. In FIGS. 9 to 11, the magnetic lines are indicated by broken lines.

In other respects, the structure and the toner cluster T eliminating operation in the second embodiment are similar to those in the first embodiment.

In this embodiment, as mentioned above, the magnet 51 has a plurality of magnetic poles (the S pole 51*a* and the N pole 51*b*) which are arranged next to each other along the circumferential direction of the magnetic pole generation member 50, and which have polarities different from each other. With this, as the magnetic pole generation member 50 rotates, the N pole and the S pole are induced alternately at the tip end portion of the regulating blade 29, and the direction (shape) of the magnetic lines of force between the tip end of the regulating blade 29 and the developing roller 25 changes. Thus, even if the toner clusters T are formed at (attached to) the tip end of the regulating blade 29, they can be effectively eliminated or reduced.

In other respects, the effects of the second embodiment are similar to those of the first embodiment.

The embodiments disclosed above should be understood to be in every aspect illustrative and not restrictive. The scope of the present disclosure is defined not by the description of the embodiments given above but by the appended claims, and should be understood to encompass any modifications made in the sense and scope equivalent to those of the claims.

For example, while the above embodiments deal with an example where the present disclosure is applied to a monochrome printer, this is not meant to limit the present disclosure. Needless to say, the present disclosure can be applied to various image forming apparatuses such as color printers, monochrome copiers, color copiers, digital multifunction peripherals, and facsimile machines provided with a developing device including a regulating member for regulating the thickness of developer on the surface of a developer carrier.

While the above embodiments deal with an example where a developing roller is provided as a developer carrier, this is in no way meant to limit the present disclosure. Instead, a magnetic roller may be provided as a developer carrier between a stirring/conveying member and the developing roller.

While the above embodiments deal with an example where the regulating blade 29 is arranged above the developing roller 25, this is in no way meant to limit the present disclosure. Instead, the regulating blade 29 may be arranged under the developing roller 25 or to the side of the developing roller 25.

While the above embodiments deal with examples where magnetic one-component developer containing magnetic toner alone is used as developer, this is in no way meant to limit the present disclosure. Instead, as developer, two-component developer containing magnetic carrier and non-magnetic toner may be used.

While the above embodiments deal with an example where one half of the magnetic pole generation member 50 is formed by the magnet 51 and the other half is formed by the magnetic member 52, this is in no way meant to limit the present disclosure. For example, one-fourth or three-fourths of the magnetic pole generation member 50 may be formed by the magnet 51, and the rest may be formed by a magnetic member 52. Or, the whole magnetic pole generation member 50 may be formed by the magnet 51.

While the second embodiment described above deals with an example where the magnet 51 is formed by one S pole 51*a* and one N pole 51*b*, this is in no way meant to limit the present disclosure. Instead, the magnet 51 may be formed by arranging a plurality of S poles 51*a* and a plurality of N poles 51*b* alternately along the circumferential direction of the magnetic pole generation member 50.

While the second embodiment described above deals with an example where the S pole 51*a* and the N pole 51*b* are arranged next to each other along the circumferential direction of the magnetic pole generation member 50, this is in no way meant to limit the present disclosure. For example, in the first embodiment described above, an S pole may be provided on the outer circumferential face side, and an N pole may be provided on the inner circumferential face side. Or, for example, in the second embodiment described above, a magnet provided with an S pole on the outer circumferential face side and an N pole on the inner circumferential face side, and a magnet provided with an N pole on the outer circumferential face side and an S pole on the inner circumferential face side may be arranged next to each other along the circumferential direction of the magnetic pole generation member 50.

While the above embodiments deal with an example where the depressed portion 40 in the regulating blade 29 is formed in a semicircular shape (180 degrees in the rotation direction) as seen in a cross-sectional view, this is in no way meant to limit the present disclosure. The depressed portion 40 may be made larger than a semicircle (larger than 180 degrees in the rotation direction) as seen in a cross-sectional view, or may be made smaller than a semicircle (smaller than 180 degrees in the rotation direction) as seen in a cross-sectional view. However, if the depressed portion 40 is made larger than a semicircle as seen in a cross-sectional view, then forming the depressed portion 40 in the regulating blade 29 is less easy, and in addition the magnetic pole generation member 50 needs to be inserted to the depressed portion 40 from an end face of the regulating blade 29 in its longitudinal direction, which makes the assembly process of the developing device 4 more complicated. If the depressed portion 40 is made smaller than a semicircle as seen in a cross-sectional view, the magnetic force of the magnetic pole induced at the tip end portion of the regulating blade 29 cannot be made larger efficiently. Thus, the depressed portion 40 is preferably formed in a semicircular shape as seen in a cross-sectional view.

While the above embodiments deal with an example where the magnetic pole generation member 50 rotates in such a direction (in the counter-clockwise direction in the diagram) that a part arranged outside of the depressed portion 40 moves away from the developing roller 25, this is in no way meant to limit the present disclosure. Instead, the magnetic pole generation member 50 may rotate in such a direction (in the clockwise direction in the diagram) that a part of the depressed portion 40 arranged outside approaches the developing roller 25. Also in that case, with the rotation of the magnetic pole generation member 50, the toner clusters T attached to the outer circumferential face of the magnetic pole generation member 50 can still be scraped off at the side face 29*a* of the regulating blade 29, and the toner clusters T around the magnetic pole generation member 50 can be thus eliminated or reduced.

While the above embodiments deal with an example where the magnet 51 is arranged outside the depressed portion 40 during image formation, this is in no way meant to limit the present disclosure. The magnet 51, during image formation, may be arranged inside the depressed portion 40. In that case, a part of the magnetic pole generation member 50 other than the magnet 51 may be formed by the magnetic member 52, or by a non-magnetic member.

Any configurations achieved by combining the configurations of the embodiments and modified examples described above are also within the technical scope of the present disclosure.

What is claimed is:

1. A developing device comprising:

a developer container for storing magnetic developer;

a developer carrier which is rotatably supported on the developer container, the developer carrier carrying the developer on an outer circumferential face thereof;

a regulating member which is arranged opposite the developer carrier at a predetermined interval and which comprises a magnetic body for regulating thickness of the developer on a surface of the developer carrier;

a regulating pole which is arranged inside the developer carrier so as to face the regulating member; and a magnetic pole generation member which is arranged on an upstream side of the regulating member in a developer carrier rotation direction and which has a magnet for generating, at a tip end portion of the regulating member, a magnetic pole of a polarity different from a pole of the regulating pole, wherein a depressed portion which has an inner face with an arc-shaped cross-section is provided in a side face of the regulating member on an upstream side in the developer carrier rotation direction, and the magnetic pole generation member is formed in a cylindrical shape with a radius substantially equal to a radius of the inner face of the depressed portion, and is rotatable while staying fitted in the depressed portion.

2. The developing device according to claim 1, wherein the magnet has a plurality of magnetic poles which are arranged next to each other along a circumferential direction of the magnetic pole generation member and which have polarities different from each other.

3. The developing device according to claim 1, wherein the magnetic pole generation member is formed by arranging the magnet and a magnetic member next to each other along the circumferential direction.

4. The developing device according to claim 3, wherein one half of the magnetic pole generation member is formed by the magnet, and another half is formed by the magnetic member along the circumferential direction.

5. The developing device according to claim 4, wherein during image formation, the magnetic member is arranged inside the depressed portion and the magnet is arranged outside the depressed portion.

6. The developing device according to claim 1, wherein the depressed portion is formed in a semicircular shape as seen in a cross-sectional view.

7. The developing device according to claim 1, wherein the magnetic pole generation member rotates in such a direction that a part arranged outside the depressed portion moves away from the developer carrier.

8. An image forming apparatus comprising the developing device according to claim 1.

* * * * *